United States Patent [19]

Shibaoka

[11] 3,994,729

[45] Nov. 30, 1976

[54] METHOD FOR PROCESSING PHOTOGRAPHIC LIGHT-SENSITIVE MATERIAL

[75] Inventor: Haruo Shibaoka, Minami-ashigara, Japan

[73] Assignee: Fuji Photo Film Co., Ltd., Minami-ashigara, Japan

[22] Filed: June 23, 1975

[21] Appl. No.: 589,644

Related U.S. Application Data

[63] Continuation-in-part of Ser. No. 458,935, April 8, 1974, abandoned.

[30] Foreign Application Priority Data

Apr. 6, 1973 Japan ..... 48-39203

[52] U.S. Cl. ..... 96/61 R; 96/66 R

[51] Int. Cl.[2] ..... G03C 5/38; G03C 5/30

[58] Field of Search ..... 96/66 R, 61 R, 50 PT, 96/22

[56] References Cited

UNITED STATES PATENTS

| | | | |
|---|---|---|---|
| 1,981,426 | 11/1934 | Muehler | 96/61 R |
| 2,203,903 | 6/1940 | Ham | 96/61 R |
| 2,378,248 | 6/1945 | Russell et al. | 96/61 R |
| 3,008,828 | 11/1961 | Henn et al. | 96/61 R |
| 3,304,179 | 2/1967 | Field et al. | 96/61 R |
| 3,677,760 | 7/1972 | Iwano et al. | 96/50 PT |
| 3,802,883 | 4/1974 | Ohkubo et al. | 96/61 R |
| R19,354 | 10/1934 | Elliott | 96/61 R |

OTHER PUBLICATIONS

The Camera, "Technical & Scientific Notes", May 1924, pp. 316–317.

British Journal of Photography, vol. 111, No. 5433, Sept. 1964, pp. 722, 723.

Handbook of Photography, Ed. by Henney & Dudley, p. 385–386, 1939.

Transactions of SMPE, vol. XIII, No. 38, 1929, Crabtree & Hart, "Some Properties of Fixing Baths", pp. 364–405.

*Primary Examiner*—Mary F. Kelley

*Attorney, Agent, or Firm*—Sughrue, Rothwell, Mion, Zinn & Macpeak

[57] ABSTRACT

A method for processing a photographic light-sensitive material, which comprises developing an exposed silver halide photographic material in a developer containing a developing agent and a dialdehyde compound, and fixing the material in a fixing solution containing (1) a thiosulfate, (2) a water-soluble aluminum salt and (3) at least 0.005 mol/liter of tartaric acid, or a salt thereof, citric acid or a salt thereof, or a mixture thereof.

7 Claims, No Drawings

METHOD FOR PROCESSING PHOTOGRAPHIC LIGHT-SENSITIVE MATERIAL

This is a continuation-in-part of application Ser. No. 458,935, filed Apr. 8, 1974, now abandoned.

BACKGROUND OF THE INVENTION

1. Field of the Invention

The present invention relates to a method for processing a photographic light-sensitive material and, more particularly, it is concerned with a method for fixing a developed photographic light-sensitive material in an acidic harden-fixing solution.

2. Description of the Prior Art

An automatic developing machine has been developed in which an exposed silver halide photographic light-sensitive material is automatically transported to be developed, fixed, washed and, in some cases, dried (for example, as disclosed U.S. Pat. Nos. 3,025,779 and 3,545,971). Therefore, the entire processing period is shortened somewhat. However, in order to shorten the entire processing period, each processing step must also be shortened. While the developing step has already been shortened, it is technically difficult to shorten the fixing step and the washing step. That is, while the time required for the developing step can be shortened comparatively easily by selecting the composition of the developer (e.g., the amount of the developing agent or the pH of the developer) or by increasing the developing temperature, it is difficult to shorten the time required for the fixing step and the washing step by such means because the rate at which the processings proceed changes little even when the solution composition is selected or the temperature of a processing solution is increased. For example, it has been suggested to increase the fixing rate by changing the fixing agent from sodium thiosulfate to ammonium thiosulfate. In this case too, however, there is a limit to the degree to which the fixing rate can be increased.

It is, therefore, an object of the present invention to provide a method for processing a photographic light-sensitive material whereby an increased fixing rate can be attained.

Another object of the present invention is to provide a method for processing a photographic light-sensitive material whereby the entire processing period can be shortened.

SUMMARY OF THE INVENTION

As a result of various investigations to attain the abovedescribed objects, the inventors have found a method of developing an exposed silver halide photographic light-sensitive material in a developer containing a developing agent and a dialdehyde compound and then processing it in a fixing solution containing a thiosulfate, a water-soluble aluminum salt and tartaric acid, citric acid or a salt thereof.

DETAILED DESCRIPTION OF THE INVENTION

It is already known that the formation of an aluminum compound which is slightly soluble in water can be prevented by adding an organic acid to a fixing solution containing both a thiosulfate (fixing agent) and a water-soluble aluminum salt (hardening agent) (so-called acidic harden-fixing solution). However, as is well known in general, a water-soluble aluminum salt shows a hardening action only when the pH of the fixing solution is in the range of from 3.8 to 5.0. Therefore, it has been believed that, in the case of adding an organic acid, it must be added in an extremely small amount (0.1 – 0.5 g/liter) so as to maintain the fixing solution in the above-described pH range. However, surprisingly enough, it has now been found that, when tartaric acid, citric acid, a salt thereof or the mixture thereof is added to the fixing solution in an amount of not less that about 0.005 mol/liter, an absolutely unexpected effect, i.e., an increase in fixing rate, is observed. Such effect is observed only with tartaric acid, citric acid or a salt thereof of the organic acids, and is not observed with other organic acids such as acetic acid, butyric acid, malic acid, phthalic acid and the like.

On the other hand, since the hardening action of the fixing solution is reduced by the addition of tartaric acid, citric acid or a salt thereof to the harden-fixing solution, it is particularly necessary to add a dialdehyde compound to the developer. Therefore, in the method of the present invention, it is of importance to use an aqueous solution containing a dialdehyde compound and the above-described acidic harden-fixing solution in combination.

The term "developer" as used herein in the present invention designates an alkaline aqueous solution containing a developing agent and a dialdehyde compound. As the developing agent, those well known in the art, such as dihydroxybenzenes (e.g., hydroquinone, chlorohydroquinone, bromohydroquinone, isopropylhydroquinone, toluhydroquinone, methylhydroquinone, 2,3-dichlorohydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-aminopyrazolines (e.g., 1-(p-hydroxyphenyl)-3-amino-pyrazoline, 1-(p-methylaminophenyl)-3-pyrazoline, 1-(p-aminophenyl)-3-aminopyrazoline, 1-(p-amino-m-methylphenyl)-3-aminopyrazoline, etc.), and the like or a mixture thereof can be used. These developing agents are well known and described in U.S. Pat. Nos. 3,183,087; 3,607,263 and 3,632,341.

As has previously been stated, since the hardening action of the fixing solution will be a somewhat reduced in the method of the present invention, a dialdehyde compound is added to the developer so as to compensate for this reduction. The dialdehyde compound includes the bisulfite adduct thereof. Detailed descriptions thereof are given in U.S. Reissue Pat. No. 26,601, U.S. Pat. Nos. 3,545,971, 3,232,761, 3,232,764, etc. Specific examples thereof include glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-ethoxyglutaraldehyde, α-n-butoxyglutaraldehyde, α-ethyl-β-ethoxyglutaraldehyde, α,α-dimethoxy dialdehyde, β-isopropylsuccinic dialdehyde, α, α-diethylsuccinic dialdehyde, butylmaleic dialdehyde, the bisulfite adducts thereof, and the like. The dialdehyde compounds are added in such amount that the sensitivity of the photographic layer to be processed is not depressed and the drying time is not seriously prolonged. More specifically they are used in an amount of about 1 to 50 g, preferably 3 to 20 g, per 1 liter of the developer.

In the developer can be incorporated, if desired, a preservative (e.g., a sulfite, a bisulfite, etc.), a buffer (e.g., a carbonate, boric acid, borate, an alkanolamine, etc.), an alkali agent (e.g., a hydroxide, a carbonate, etc.), a dissolving aid (e.g., polyethylene glycols, the esters thereof, etc.), a pH-adjusting agent (e.g., acetic acid or a like organic acid), a sensitizing agent (e.g., a quaternary ammonium salt, etc.), a development accelerator, a surface active agent, and the like. These addenda and the amounts thereof generally used are well known in the art and are described, for example, in U.S. Pat. Nos. 2,648,604; 3,672,247; 2,533,990; 2,577,127; 2,950,970; 3,068,097; 2,496,940; 3,161,513; 3,161,514; 3,536,487, etc.

In the developer can further be incorporated a dispersing agent for colloidal silver which is dissolved out (e.g., a mercapto compound, etc. as disclosed in U.S. Pat. Nos. 2,496,940 and 2,656,271), an anti-fogging agent (e.g., potassium bromide, sodium bromide or a like halide, a benzotriazole, a benzothiazole, a tetrazole, a thiazole, etc.) and a chelating agent (e.g., ethylenediaminetetraacetic acid, an alkali metal salt thereof, a polyphosphate, nitriloacetate, etc.).

The pH of the thus prepared developer is selected so that the desired density and contrast can be provided, and is preferably within the range of from about 9.5 to about 10.5

The development-processing temperature and time are correlated with each other and are decided taking the entire processing time into consideration. In general, the development processing is conducted at about 20° C to about 50° C for 10 seconds to 3 minutes.

On the other hand, as has previously been stated, the fixing solution is an aqueous solution containing a thiosulfate, a water-soluble aluminum compound and tartaric acid, citric acid or the salt thereof, and is preferably at pH of about 3.8 to about 5.0 (20° C).

In the method of the present invention, it is possible to provide a stopping step after development processing. In a roller-carrying type automatic developing machine, however, such a stopping step is omitted. Therefore, the developer is partly carried over into the fixing solution, resulting in an increase in pH of the fixing solution. For this reason, it is desirable to adjust the pH of the fixing solution to about 3.8 to about 4.6 (20° C).

As the fixing agent, thiosulfates such as ammonium thiosulfate, sodium thiosulfate, etc. can be used as disclosed in U.S. Pat. No. 3,582,322. From the standpoint of the fixing rate, ammonium thiosulfate is particularly preferable. The amount of the fixing agent used can be appropriately changed, and is in general about 0.1 to about 5 mol/liter.

The water-soluble aluminum salt which functions mainly as a hardener in the fixing solution is a compound generally known as a hardener for an acidic harden-fixing solution. There are illustrated, for example, aluminum chloride, aluminum sulfate, potassium alum, and the like. A suitable solubility in water is a solubility of about 0.01 mol/liter or greater.

Tartaric acid or the derivative thereof added to the fixing solution of the present invention can be in various forms. However, optical isomers thereof are of not particular concern in the present invention. That is, although tartaric acid can be in isomeric form such as L-tartaric acid, D-tartaric acid, mesotartaric acid, DL-tartaric acid, etc., any of these isomers provide the same effects with respect to the objects of the present invention. Suitable derivatives of tartaric acid are the metal salts. In the present invention, however, particularly preferable derivatives are mainly the metal salts. Examples of metals capable of forming a salt with tartaric acid are sodium, potassium, lithium, aluminum, antimony, cobalt, magnesium, etc. The ammonium salt thereof is also preferable as well as the metal salts. In addition, a mixture of two or more metal salts or a mixture of a metal salt and an ammonium salt is also preferable. More specifically, tartaric acid, potassium tartrate, sodium tartrate, potassium hydrogentartrate, sodium hydrogentartrate, sodium potassium tartrate, ammonium tartrate, ammonium potassium tartrate, antimony potassium tartrate, antimony sodium tartrate, lithium hydrogentartrate, lithium tartrate, magnesium hydrogentartrate, potassium boron tartrate, potassium lithium tartrate, etc., are suitable.

Citric acid or the derivative thereof which is useful in the present invention is mainly of a metal salt type which are water-soluble. However, the invention is not limited only to the compounds illustrated below. Suitable citric acid compounds are citric acid, sodium citrate, potassium citrate, lithium citrate, ammonium citrate, etc.

The above-described tartaric acid or the derivative thereof and citric acid or the derivative thereof can be used alone or in combination of two or more. These compounds are effectively incorporated in an amount of not less than 0.005 mol/liter of the fixing solution, in particular, 0.005 mol/liter to 0.04 mol/liter, preferably 0.007 to 0.038 mol/liter.

The fixing solution can contain, if desired, a preservative (e.g., a sulfite, a bisulfite, etc.), a pH buffer (e.g., boric acid, a borate, etc.), a pH-adjusting agent (e.g., acetic acid, etc.), and a chelating agent (as described hereinbefore).

The fixing temperature and time are the same as in the case of development, and are preferably about 20° C to about 50° C and 10 seconds to 3 minutes, respectively.

According to the method of the present invention, the developed and fixed photographic material is washed with water and dried. Washing is conducted in order to substantially completely remove the silver salt which has been dissolved in the fixing processing, and is preferably conducted at about 20° C to about 50° C for 10 seconds to 3 minutes. Drying is conducted at about 40° C to about 100° C. The drying time can appropriately be changed depending upon the ambient conditions, but is usually about 5 seconds to 3 minutes and 30 seconds. The use of 0.005 to 0.04 mol/liter, preferably 0.007 to 0.038 mol/liter of the tartaric or citric acid, or combination or derivatives thereof, in combination with the particular type of dialdehyde hardening agent enables the employment of lower drying temperature.

U.S. Pat. Nos. 3,025,779, 3,545,971, etc. describe a roller-carrying type processing machine, which is merely referred to as a roller-carrying type processor in the present specification. The roller-carrying type processor accomplishes the four steps of development, fixing, washing and drying. In the method of the present invention too, it is the most preferable to follow these four steps, although other steps (e.g., a stopping step, etc.) can also be included.

A silver halide photographic light-sensitive material to which the method of the present invention is applicable comprises a support having coated thereon at least one silver halide emulsion layer, for example, as described in U.S. Reissue Pat. No. 26,601. This silver halide emulsion layer can be coated on both sides as well as on one side of the support. Of course, the photographic light-sensitive material can contain, if desired, a tacking layer, an anti-halation layer, an intermediate layer, an uppermost layer (e.g., protective layer, etc.), and the like.

The silver halide emulsion is prepared by dispersing a silver halide such as silver chloride, silver iodide, silver bromide, silver chlorobromide, silver bromoiodide or silver chlorobromoiodide in a hydrophilic colloid (e.g., gelatin, modified gelatin, colloidal albumin, casein, carboxymethyl cellulose, hydroxyethyl cellulose, sodium alginate, polyvinyl alcohol, polyvinyl pyrrolidone, the mixture thereof, etc.).

The silver halide emulsion can be produced according to a method generally well known in the art (e.g., a single jet method, a double jet method, a controlled jet method, etc.) by mixing a water-soluble silver salt (e.g., silver nitrate, etc.) and a water-soluble halide as disclosed, for example, in U.S. Pat. Nos. 1,574,944; 2,222,264; 2,399,083; 2,598,079; 2,614,928; 2,646,426; 3,276,877; 3,320,069; 3,622,318; etc., in the presence of water and a hydrophilic collid as disclosed in U.S. Pat. Nos. 2,614,928; 3,118,366; 3,132,945; 3,186,846; 2,594,293; 3,312,553; 2,763,639; 2,763,625; 2,831,767; 2,956,884; etc., followed by physical ripening and chemical ripening such as gold sensitization and/or sulfur sensitization as disclosed in U.S. Pat. Nos. 2,399,083; 2,540,085; 2,597,856; 2,597,915; 2,448,060; 2,540,086; 2,566,245; 2,566,263; 2,598,079; 1,574,944; 2,410,689; 3,189,458; 3,501,313; 2,487,850; 2,518,698; 2,521,925; 2,521,926; 2,694,637; 2,683,610; 3,201,254; etc. To the silver halide emulsion can be added, during the step of production thereof or immediately before coating, a spectrally sensitizing agent (e.g., a cyanine dye, a merocyanine dye, a mixture thereof, etc. as disclosed in U.S. Pat. Nos. 2,493,748; 2,519,001; 2,977,229; 3,480,434; 3,672,897; 3,703,377; 2,688,545; 2,912,329; 3,397,060; 3,615,635; 3,628,964; 3,511,664; 3,522,052; 3,527,641; 3,615,613; 3,615,632; 3,617,295; 3,625,721; 3,694,217; etc.), a stabilizing agent (e.g., 4-hydroxy-6-methyl-1,3,3a,7-tetrazaindene, etc.), a sensitizing agent (e.g., the compounds described in U.S. Pat. No. 3,619,198), an anti-fogging agent (e.g., benzotriazole, 5-benzimidazole, polyethylene oxide, etc.), a hardener (e.g., formaldehyde, glyoxal, mucochloric acid, 2-hydroxy-4,6-dichloro-s-triazine, etc.), a coating aid (e.g., saponin, sodium laurylsulfate, dodecylphenol polyethylene oxide ether, hexadecyltrimethylammonium bromide etc.), and the like. The thus prepared silver halide emulsion is then applied to a support such as a baryta paper, a resin-coated paper, a cellulose acetate film, a polyethylene terephthalate film or the like using a dip-coating method, an air knife-coated method, a bead coating method, an extrusion doctor method, a both sides coating method or the like, followed by drying.

The composition of silver halide and the kinds of additives and support of the above-illustrated silver halide photographic light-sensitive material vary depending upon the end-use purposes. The light-sensitive materials to which the method of the present invention is applicable include black-and-white photographic materials (e.g., X-ray photographic materials for medical or industrial use, lithographic photographic materials, photographic materials for ordinary photography, etc.) and color photographic materials.

EXAMPLE 1

Photographic materials comprising a polyethylene terephthalate film having coated on both sides thereof a gelatino-silver bromoiodide emulsion layer (silver iodide: 1.5 mol%, gelatin amount: 50 g/mol AgX) in a silver amount (calculated as silver halide) of 20 mg/100 $cm^2$ and a gelatin amount of 25 mg/100 $cm^2$ and a gelatin protective layer in a gelatin amount of 10 mg/100 $cm^2$ were exposed and subjected to the following processings using a roller-carrying type processor.

| | Processing Temperature | Processing Time |
|---|---|---|
| Development | 37° C | 13 sec |
| Fixing | 36° C | 13 sec |
| Washing | 35° C | 13 sec |
| Drying | 60° C | 13 sec |

The compositions of the developer and the fixing solution were as follows. As the fixing solution, two Fixing Solutions A and B were used.

| Developer: | |
|---|---|
| Water | 500 ml |
| Hydroxyethyl Ethylenediamine-triacetic Acid | 0.8 g |
| Sodium Sulfite (anhydrous) | 50.0 g |
| Potassium Hydroxide | 20.0 g |
| Hydroquinone | 25.0 g |
| 1-Phenyl-5-pyrazolidone | 1.5 g |
| Boric Acid | 10.0 g |
| Triethylene Glycol | 25.0 g |
| Glutaraldehyde | 5.0 g |
| Potassium Bromide | 6.0 g |
| Glacial Acetic Acid | 3.0 g |
| Sodium Bisulfite (anhydrous) | 4.5 g |
| 5-Nitroindazole | 0.03 g |
| 1-Phenyl-5-methylmercaptotetrazole | 0.005 g |
| 5-Methylbenzotriazole | 0.005 g |
| Water to make | 1 liter |

The pH value of the developer at 20° C was about 10.30.

| Fixing Solution A: | |
|---|---|
| Water | 500 ml |
| Ammonium Thiosulfate | 200.0 g |
| Sodium Sulfite (anhydrous) | 20.0 g |
| Boric Acid | 8.0 g |
| Disodium Ethylenediamine-tetraacetate | 0.1 g |
| Aluminum Sulfate | 15.0 g |
| Sulfuric Acid | 2.0 g |
| Glacial Acetic Acid | 22.0 g |
| Water to make | 1.0 liter |

The pH value of the Fixing Solution A at 20° C was about 4.10.

| Fixing Solution B: | |
|---|---|
| Water | 500 ml |
| Ammonium Thiosulfate | 200.0 g |
| Sodium Sulfite (anhydrous) | 20.0 g |
| Boric Acid | 8.0 g |
| Disodium Ethylenediamine-tetraacetate | 0.1 g |
| Potassium Sodium Tartrate | 5.0 g |

-continued

| Fixing Solution B: | |
|---|---|
| Sodium Hydroxide | 0.25 g |
| Aluminum Sulfate | 15.0 g |
| Sulfuric Acid | 2.0 g |
| Glacial Acetic Acid | 22.0 g |
| Water to make | 1.0 liter |

The pH value of the Fixing Solution B at 20° C was about 4.10.

After processing the films, the thiosulfate amount and silver amount remaining in the processed photographic materials were measured. The properties of Fixing Solution A and Fixing Solution B were compared at two points: one being a point where the fixing solutions were fresh and contained no silver; and the other being a point where the silver amount in the fixing solutions reached 5.0 g/liter after processing some films. The results obtained are shown in the following table.

| Fixing Solution | Silver Amount Remaining in Photographic Material ($\mu g/cm^2$) | | Thiosulfate Amount Remaining in Photographic Material ($\mu g/cm^2$) | |
|---|---|---|---|---|
| | Silver Amount in Fixing Solution: 0g/liter | Silver Amount in Fixing Solution: 5g/liter | Silver Amount in Fixing Solution: 0g/liter | Silver Amount in Fixing Solution: 5g/liter |
| A | 2 | 20 | 30 | 48 |
| B | 0 | 0 | 15 | 17 |

As is clear from the results given in the above table, it is apparent that the fixing solution of the present invention shows markedly excellent properties, not only when it is fresh but also when the silver content thereof is increased, as compared with a conventional fixing solution.

EXAMPLE 2

Photographic materials comprising a polyethylene terephthalate film having coated on both sides thereof a gelatino-silver bromoiodide emulsion layer (silver iodide: 2 mol%; gelatin amount: 50 g/mol AgX) in a silver amount (calculated as silver halide) of 60 mg/100 $cm^2$ and a gelatin amount of 60 mg/100 $cm^2$ and a gelatin protective layer in a gelatin amount of 10 mg/100 $cm^2$ were exposed and subjected to the following processings using a roller-carrying type processor.

| | Processing Temperature | Processing Time |
|---|---|---|
| Development | 33° C | 55 sec |
| Fixing | 32° C | 55 sec |
| Washing | 32° C | 55 sec |
| Drying | 55° C. | 25 sec |

The compositions of the developer and the fixing solution were as follows. As the fixing solution, three Fixing Solutions C, D and E were used.

| Developer: | |
|---|---|
| Water | 500 ml |
| Glycol Ether Diamine-tetraacetic Acid | 0.5 g |
| Sodium Bisulfite | 50.0 g |
| Potassium Hydroxide | 36.0 g |
| Hydroquinone | 25.0 g |
| 1-Phenyl-3-pyrazolidone | 1.0 g |
| Triethylene Glycol | 20.0 g |
| Potassium Carbonate | 10.0 g |
| Glutaraldehyde-Busulfite Adduct | 25.0 g |
| Sodium Bromide | 8.0 g |
| Glacial Acetic Acid | 2.0 g |
| 5-Nitrobenzimidazole | 0.02 g |
| Water to make | 1.0 liter |

| Fixing Solution C: | |
|---|---|
| Water | 5 ml |
| Ammonium Thiosulfate | 180 g |
| Sodium Thiosulfate (5 $H_2O$) | 45 g |
| Sodium Sulfite (anhydrous) | 18 g |
| Boric Acid | 7.5 g |
| Aluminum Chloride (6 $H_2O$) | 20.0 g |
| Nitrilotriacetic Acid | 0.3 g |
| Glacial Acetic Acid | 18.0 g |
| Sulfuric Acid | 1.6 g |
| Water to make | 1.0 liter |

Fixing Solution D

Prepared by adding 0.5 g of tartaric acid to Fixing Solution C.

| Fixing Solution E: | |
|---|---|
| Water | 500 ml |
| Ammonium Thiosulfate | 180 g |
| Sodium Thiosulfate (5 $H_2O$) | 45 g |
| Sodium Sulfite (anhydrous) | 18 g |
| Boric Acid | 7.5 g |
| Aluminum Chloride (6 $H_2O$ | 20.0 g |
| Nitrilotriacetic Acid | 0.3 g |
| Tartaric Acid | 3.5 g |
| Glacial Acetic Acid | 18.0 g |
| Sulfuric Acid | 1.2 g |
| Water to make | 1 liter |

The pH values of Fixing Solutions C, D and E at 20° C were all about 4.20.

The silver amount and thiosulfate amount remaining in the photographic materials were measured in a manner similar to Example 1. The properties of Fixing Solutions C, D and E were compared at two points: one being a point where the fixing solutions contained no silver; and the other being a point where the silver amount in the fixing solutions reached 7.5 g/liter after processing some films. The results are shown in the following table:

| Fixing Solution | Amount of Silver Remaining in Photographic Material ($\mu g/cm^2$) Silver Amount in Fixing Solution: 0 g/liter | Silver Amount in Fixing Solution: 7.5 g/liter | Amount of Thiosulfate Remaining in Photographic Material ($\mu g/cm^2$) Silver Amount in Fixing Solution: 0 g/liter | Silver Amount in Fixing Solution: 7.5 g/liter |
|---|---|---|---|---|
| C | 10 | 30 | 40 | 140 |
| D | 0 | 29 | 38 | 135 |
| E | 0 | 5 | 10 | 13 |

As is clear from the above-described results, the combination of the developer and Fixing Solution E in accordance with the present invention markedly reduces the silver amount and thiosulfate amount remaining in the processed films as compared with the conventional combination of the developer and Fixing Solution C or E. In addition, the gelatin film of the photographic materials processed by the two methods was not delaminated or scratched. Thus, well finished films were obtained.

It should particularly be noted that the effects of the present invention cannot be obtained by adding 0.5 g of tartaric acid alone (Fixing Solution D).

EXAMPLE 3

A gelatino silver iodobromide emulsion coated on a cellulose triacetate support were processed using a roller-carrying type processor and the following developer and Fixing Solution F or G. Each of the development, fixing and washing was conducted for 1 minute, and then drying for 1 minute and 20 seconds. The developing temperature was 27° C, the fixing and washing temperature 25° C, and the drying temperature 50° C.

| Developer: | |
|---|---|
| Water | 600 ml |
| Monomethyl-p-aminophenol | 2 g |
| Sodium Sulfite (anhydrous) | 100 g |
| 1-Phenyl-3-pyrazolidone | 0.2 g |
| Sodium Carbonate | 45 g |
| Sodium Hexametaphosphate | 0.5 g |
| Glutaraldehyde-Sodium Bisulfite Adduct | 10 g |
| 5-Chlorobenzotriazole | 0.03 g |
| Hydroquinone | 10 g |
| Water to make 1 l | |
| **Fixing Solution F:** | |
| Water | 500 ml |
| Ammonium Thiosulfate | 170 g |
| Sodium Sulfite (anhydrous) | 15 g |
| Boric Acid | 7 g |
| Glacial Acetic Acid | 15 g |
| Potash Alum | 20 g |
| Ethylenediaminetetraacetic Acid | 0.1 g |
| Water to make | 1 liter |
| **Fixing Solution G:** | |
| Water | 500 ml |
| Ammonium Thiosulfate | 170 g |
| Sodium Sulfite (anhydrous) | 15 g |
| Boric Acid | 7 g |
| Sodium Citrate | 2.5 g |
| Glacial Acetic Acid | 15.2 g |
| Potassium Alum | 20 g |
| Ethylenediaminetetraacetic Acid | 0.1 g |
| Water to make | 1 liter |

The pH values of Fixing Solutions F and G at 20° C were about 4.40.

The silver amount and thiosulfate amount remaining in the photographic materials were measured in a similar manner to Example 1. As Fixing Solutions F and G, those in which silver concentration reached 2.8 g/liter after processing some films were used.

| Fixing Solution | Amount of Silver Remaining in Photograhic Material ($\mu g/cm^2$) | Amount of Thiosulfate Remaining in Photograhic Material ($\mu g/cm^2$) |
|---|---|---|
| F | 9 | 70 |
| G | 2 | 11 |

EXAMPLE 4

A series of photosensitive materials comprising a polyethylene terephthalate film, which had been coated on both sides thereof with a gelatin-silver bromoiodide emulsion layer (silver iodide: 0.5 mol%; gelatin amount: 47.5 g/mol AgX) at a rate of silver halide 55 mg/100 $cm^2$ and gelatin 57 mg/100 $cm^2$ and a gelatin protective layer at a rate of gelatin 10 mg/100 $cm^2$, were exposed and subjected to the following processing using a roller-carrying type processor.

| | Processing Temperature (°C) | Processing Time (Sec.) |
|---|---|---|
| Development | 33 | 55 |
| Fixing | 32 | 55 |
| Washing | 32 | 55 |
| Drying | 48–68 | 25 |

The compositions of the developer and the fixing solution are as follows.

| Developer A (same as in Example 2): | |
|---|---|
| Water | 500 ml |
| Glycol ether diamine tetraacetic acid | 0.5 g |
| Sodium bisulfite | 50.0 g |
| Potassium hydroxide | 36.0 g |
| Hydroquinone | 25.0 g |
| 1-Phenyl-3-pyrazolidone | 1.0 g |
| Triethylene glycol | 20.0 g |
| Potassium carbonate | 10.0 g |
| Glutaraldehyde-bisulfurous acid adduct | 25.0 g |
| Sodium bromide | 8.0 g |
| Glacial acetic acid | 2.0 g |
| 5-Nitrobenzimidazole | 0.02 g |
| Water to make | 1.0 liter |

The pH value of this developer is about 10.20 at 20° C.

Developer B 25.0 g of glutaraldehyde-bisulfurous acid adduct in Developer A are substituted by 1.0 g of o-phthalaldehyde described in the U.S. Pat. No. 3,677,760 and 1.8 g of potassium hydroxide are added to make the pH value 10.20 at 20° C.

Developer C 25.0 g of glutaraldehyde-bisulfurous acid adduct are eliminated from the composition of Developer A and 1.7 g of potassium hydroxide are added to make the pH value 10.20 at 20° C.

| Fixing solution C (same as in Example 2): | | |
|---|---|---|
| Water | 500 | ml |
| Ammonium thiosulfate | 180.0 | g |
| Sodium thiosulfate ($5H_2O$) | 45.0 | g |
| Sodium sulfite (anhydrous) | 18.0 | g |
| Boric Acid | 7.5 | g |
| Aluminum chloride ($6H_2O$) | 20.0 | g |
| Nitrilotriacetic acid | 0.3 | g |
| Glacial acetic acid | 18.0 | g |
| Sulfuric acid | 1.6 | g |
| Water to make | 1.0 | liter. |

Fixing solution 1.63 g of citric acid (0.0085 mol/l) and 0.13 g of sodium hydroxide are added to the fixing solution C (the same mol as in Example 3 is used).

Fixing solution I 4.42 g of citric acid (0.023 mol/l) and 0.36 g of sodium hydroxide are added to the fixing solution C (the same mol as in Example 2 is used).

Fixing solution J 7.38 g of citric acid (0.038 mol/l) and 0.6 g of sodium hydroxide are added to the fixing solution C.

Fixing solution K 7.92 g of citric acid (0.0412 mol/l) and 0.65 g of sodium hydroxide are added to the fixing solution C (the same mol as in the U.S. Pat. Re No. 19,354).

The pH value of the fixing solution C,H,I,L and K is about 4.20 at 20° C.

In the combination of the developers A,B and C with the fixing solutions C,H,I,J and K, the remaining amount of silver and thiosulfate in the photosensitive material treated as well as the drying temperature necessary for obtaining a same drying level of the photosensitive material to be treated in an automatic developing machine are summarized as follows:

| Experiment No. | Developer | Fixing solution | Remaining amount of silver ($\mu g/cm^2$) | Remaining amount of thiosulfate ($\mu g/cm^2$) | Drying Temperature (°C) |
|---|---|---|---|---|---|
| 1 | A | C | 5 | 36 | 48 |
| 2 | A | H | 2 | 18 | 48 |
| 3 | A | I | 0 | 4 | 50 |
| 4 | A | J | 0 | 0 | 53 |
| 5 | A | K | 0 | 0 | 58 |
| 6 | B | C | 7 | 75 | 53 |
| 7 | B | H | 7 | 59 | 53 |
| 8 | B | I | 5 | 39 | 55 |
| 9 | B | J | 2 | 17 | 60 |
| 10 | B | K | 2 | 16 | 67 |
| 11 | C | C | 8 | 77 | 58 |
| 12 | C | H | 7 | 62 | 59 |
| 13 | C | I | 6 | 38 | 60 |
| 14 | C | J | 3 | 19 | 63 |
| 15 | C | K | 3 | 19 | 68 |

As seen from the above result, as the amount of citric acid in the fixing solution is increased, both the remaining amount of silver and thiosulfate in the sensitive material treated are decreased with marked difference of values thereof between developers; i.e., the amount of remaining silver and thiosulfate are almost the same with developers B and C, but much greater than with the developer A. Amounts of remaining silver and thiosulfate are less with developer A. Further, it is significant that there is a difference in drying temperatures necessary for obtaining the same drying level. A higher temperature is not desirable because it means a larger drying load. The drying temperature is increased with developer A, B or C, as the amount of citric acid in the fixing solution is increased. This means that it is more difficult to dry the photosensitive material. Developers B and C require a larger drying load compared with the developer A.

From the above result, it is clear that the preferred type of film hardener used in the developer and amount of citrate used in the fixing solution are defined in this application in view of the amount of remaining compounds in the photosensitive material treated and the drying load needed in the treatment of the photosensitive material.

While the invention has been described in detail and with reference to specific embodiments thereof, it will be apparent to one skilled in the art that various changes and modifications can be made therein without departing from the spirit and scope thereof.

What is claimed is:

1. A method for processing a photographic light-sensitive material, which comprises developing an imagewise exposed silver halide photographic material in a developer containing a developing agent and dialdehyde compound hardening agent selected from the group consisting of glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-ethoxyglutaraldehyde, β-n-butoxyglutaraldehyde, α-ethyl-β-ethoxyglutaraldehyde, α, α-dimethoxysuccinic dialdehyde, β-isopropylsuccinic dialdehyde, α,α-diethylsuccinic dialdehyde, butylmaleic dialdehyde, the bisulfite adducts thereof and mixtures thereof, and fixing said material in a fixing solution containing (1) a thiosulfate, (2) a water-soluble aluminum salt and (3) 0.005 mol/liter to 0.04 mol/liter of tartaric acid, or a salt thereof, citric acid or a salt thereof, or a mixture thereof.

2. The method of claim 1, wherein said water-soluble aluminum salt is aluminum chloride, aluminum sulfate, potassium alum, or a mixture thereof.

3. The method of claim 1, wherein said tartaric acid or a salt thereof is tartaric acid, potassium tartrate, sodium tartrate, potassium hydrogen tartrate, sodium hydrogen tartrate, sodium potassium tartrate, ammonium tartrate, ammonium potassium tartrate, antimony potassium tartrate, antimony sodium tartrate, lithium hydrogen tartrate, lithium tartrate, magnesium hydrogen tartrate, potassium boron tartrate, potassium lithium tartrate or a mixture thereof, and wherein said citric acid or a salt thereof is citric acid, sodium citrate, potassium citrate, lithium citrate, ammonium citrate, or a mixture thereof.

4. The method of claim 1, wherein said developing agent is a dihydroxybenzene, a 3-pyrazolidone, an aminophenol, pyrogallol, ascorbic acid, a 1-aryl-3-aminopyrazoline or a mixture thereof.

5. The method of claim 1, wherein said developer contains at least one of a preservative, a buffer, an alkali agent, a dissolving aid, a pH-adjusting agent, a sensitizing agent, a development accelerator, a surface active agent, a silver colloid dispersing agent, an anti-fogging agent, and a chelating agent, and wherein said developer has a pH ranging from about 9.5 to about 10.5 and wherein said fixing solution contains at least one of a preservative, a pH buffer, a pH-adjusting agent, and a chelating agent, and wherein said fixing solution has a pH ranging from about 3.8 to about 5.0.

6. The method of claim 1, wherein said dialdehyde compound is present in said developer in an amount of from about 1 to 50 g per liter of said developer and wherein said thiosulfate is present in said fixing solution in an amount of from about 0.1 to about 5 mol/liter of said fixing solution.

7. The method of claim 1, wherein said tartaric acid or a salt thereof, said citric acid or a salt thereof, or said mixture thereof, is present in said fixing solution in an amount of about 0.007 mol/liter to 0.038 mol/liter of said fixing solution.

* * * * *